US006028565A

United States Patent [19]

Mackenzie et al.

[11] Patent Number: 6,028,565

[45] Date of Patent: Feb. 22, 2000

[54] W-BAND AND X-BAND RADOME WALL

[75] Inventors: S. Benjamin Mackenzie, Rootstown; David W. Stressing, Kent, both of Ohio

[73] Assignee: Norton Performance Plastics Corporation, Wayne, N.J.

[21] Appl. No.: 08/751,349

[22] Filed: Nov. 19, 1996

[51] Int. Cl.[7] ..... H01Q 1/42

[52] U.S. Cl. ..... 343/872

[58] Field of Search ..... 343/872, 873; H01Q 1/42

[56] References Cited

U.S. PATENT DOCUMENTS

| | | | |
|---|---|---|---|
| 2,614,059 | 10/1952 | Cooper | 154/110 |
| 3,063,654 | 11/1962 | Youngren et al. | 244/14 |
| 3,292,544 | 12/1966 | Caldwell et al. | 102/92.5 |
| 3,713,961 | 1/1973 | Copeland et al. | 161/93 |
| 4,613,540 | 9/1986 | Traut et al. | 428/212 |
| 4,783,666 | 11/1988 | Ast et al. | 343/872 |
| 4,876,055 | 10/1989 | Cattanach | 264/512 |
| 4,896,164 | 1/1990 | Burke et al. | 343/872 |
| 4,917,945 | 4/1990 | Cattanach | 428/313.3 |
| 4,956,393 | 9/1990 | Boyd et al. | 521/54 |
| 5,134,421 | 7/1992 | Boyd et al. | 343/872 |
| 5,167,870 | 12/1992 | Boyd et al. | 525/540 |
| 5,208,603 | 5/1993 | Yee | 343/909 |
| 5,323,170 | 6/1994 | Lang | 343/872 |
| 5,344,685 | 9/1994 | Cassell | 428/66 |
| 5,408,244 | 4/1995 | Mackenzie | 343/872 |

OTHER PUBLICATIONS

Jacobson , Mark D.; Snider, Jack B.; Hogg, David C.; "Comparison of Two Multisheet Transmission Windows for Millimeter–Wave Radiometers", *IEEE Transactions on Antennas and Propagation*, vol. 36, No. pp. 535–542, Apr., 1988.

Crowe, B. J.; "Dual Band Radome Wall Design", Georgia Inst. of Technology Proc. of the Symp on Electormagnetic Windows (17th), Part 2, pp. 61–65, 1984.

Loyet, D. L.; "Multiple Frequency Radomes", Symposium on Electromagnetic Windows, 13th, Atlanta, Ga., Sep. 21–23, 1976 Proceedings., pp. 149–153. 1977.

Moorefield, S.A.; Styron, J.B.; "Polyimides For Advanced Radomes", Proceedings of the Fifth National Technical Conference, S.A.M.P.E., Kiamesha Lake, NY., Oct. 9–11, 1973, p. 71–79, 1973.

"New–Generation Nose Radome", *The Composites & Adhesives Newsletter*, 8,, No. 1, Oct./Nov. 1991, p. 11.

"Improved Core Materials Have Higher Heat and Chemical Resistance", *Advanced Materials Newsletter* 10, No. 14 Aug. 22, 1988, p. 4.

Barracuda Technologies Advertisement, *Aviation Equipment Maintenance*, Apr. 1992, p. 5.

"The Problem Solver . . . WeatherMaster", *Technical Service Bulletin of BarracudaTechnologies*, date unknown.

"Barracuda Introduces New Nose Radome", *General News Release*, Apr. 15, 1991.

Mayor, Ramon A.; Welsh, Earle A.; Ossin, Archie; "Material Selection For Cost Effective Millimeter Wave Radomes", *SAMPE Quarterly*, Apr., 1980 pp. 1–7.

"RP Developments", *Reinforced Plastics*, Jan., 1988, pp. 14, 16.

*Primary Examiner*—Michael C. Wimer
*Attorney, Agent, or Firm*—Volker R. Ulbrich

[57] ABSTRACT

A radome wall construction is provided which includes a sandwich of impact resistant thermoplastic closed cell foam core bounded by epoxy/quartz laminate facings. The facings are dimensioned to be a half wavelength wall for a 94 GHz wave and thinwall for a 9.345 GHz wave. The radome wall can be used for making radomes for aircraft while maintaining satisfactory transmission efficiency for both the X-band weather radar and W-band imaging radar.

17 Claims, 3 Drawing Sheets

W-BAND AND X-BAND RADOME WALL

This invention is related to co-owned U.S. Pat. No. 5,408,244, entitled "Radome Wall Design Having Broadband and MM-Wave Characteristics", which is hereby incorporated by reference herein in its entirety.

1. Field of the Invention

This invention relates broadly to radomes. More particularly, this invention relates to X-band and W-band radomes used on air transport aircraft.

2. State of the Art

Aircraft utilize radar to assist in navigating when visibility is decreased due to atmospheric conditions. Weather radar devices, operating within the X-band at approximately 9.345 GHz, permit pilots to locate and navigate through or around stormy weather. Weather radar can locate and indicate storm conditions, but cannot provide television type images. A synthetic vision millimeter wave imaging radar system is currently being developed which operates within the W-band at 94 GHz. It has been found that at 94 GHz there is an atmospheric window which permits radar to image through fog. A narrow beam width of the 94 GHz radar is transmitted from the radar system of the aircraft through the fog. The pilot of the aircraft utilizes a heads up display (HUD) to visualize the image obtained from the 94 GHz radar. The HUD includes a pull-down transparent glass screen, similar to a sun visor, and a projector above the pilot, which projects a television type image of the airfield onto the glass screen. The image of the HUD is boresighted (aligned) with the pilot's view of the airfield.

A radome is an electromagnetic cover for an aircraft's radar system. On commercial air transport aircraft, e.g., passenger planes, the nose of the aircraft is a radome. When a radar system is mounted onto an aircraft it is necessary to cover the system with a radome which will protect the radar system from the environment, shielding the system from wind and rain. It is also desirable for the radome to provide a light eight housing for the system which conforms to the contours of an aircraft and provides a low aerodynamic drag. In satisfying these requirements, it is important that the radome not substantially adversely affect the radar when the radar energy passes through the radome and also when the reflected radar energy enters back through the radome to be received by the radar antenna. Therefore, the radome must have two primary qualities: sufficient structural integrity and durability for the environmental elements, and adequate electromagnetic properties providing a satisfactory transmission efficiency of radar energy through the radome.

The electromagnetic performance of a radome is measured by a radome's ability to minimize reflection, distortion and attenuation of radar waves passing through the radome in one direction. The transmission efficiency of a radome is analogous to the radome's apparent transparency to the radar waves and is expressed as a percent of the radar's transmitted power measured when not using a radome cover on the system. As radomes are electromagnetic devices, transmission efficiency can be optimized by tuning the radome. The tuning of a radome is managed according to several factors, including thickness of the various layers in the radome wall and the dielectric constant and loss tangent of the materials, each of which is a function of the transmission frequencies of the aircraft's radar system(s). A radome which is poorly tuned will attenuate, scatter, and reflect the beam in other directions. This can result in the blurring of the reconstructed image and cause reduced imaging range and false targets.

As the radomes are tuned, like an antenna, the dielectric quality of the manufacturing materials, that is the ability of the materials to maintain an electric field with a minimum loss of power, is likewise important. Materials having a lower dielectric constant are less likely to affect the transmission of radar energy than materials having a high dielectric constant. However, low dielectric materials are generally porous and do not alone have the strength or durability for radome construction. Materials having a higher dielectric constant are generally denser and provide the compressive and flexural strength and the stiffness necessary for most radome construction. However, unless the thickness of such materials is optimized for the specific radar application, which may require a very thin layer, higher dielectric materials can disrupt radar transmission. As a result, sandwiched layers of relatively low and high dielectric materials are often used in radome manufacture. The sandwiched layers usually include one or more core layers of a low dielectric material and one or more laminate layers of a higher dielectric material.

Laminate layers of higher dielectric materials having a tuned thickness one half the wavelength of the frequency of the wave (or any integer multiple thereof) can be tuned to have satisfactory transmission efficiency. In addition, "thinwalls" for radomes, that is laminate layers which have a thickness which does not exceed 5% of the wavelength of a radar's frequency through the particular material of manufacture, also results in a radome having satisfactory performance. However, thinwall performance starts degrading exponentially with an increase in thickness of the high dielectric laminate layer beyond 5% of the wavelength. The optimum combined thickness of the core and laminate layers is approximately a quarter wavelength of a radar's frequency through the core layer.

A radome should have a relatively uniform or constant transmission efficiency over the entire scan limits of the antenna, behaving substantially the same when transmitting radar at various beam to wall angles. For example, when the radar system is transmitting and receiving out of the side of the nose of the plane, the reflection, attenuation, and distortion should not be unacceptably different than when the radar is transmitting out of the front of the nose of the plane.

One prior art radome wall construction which has been found to perform well for X-band weather radar is referred to as an A-sandwich construction. Referring to FIG. 1, an A-sandwich radome wall 10 is a low dielectric honeycomb core 12 bounded by a thin epoxy/fiberglass laminate facing 14, 16 having relatively higher dielectric constant. A 9.345 GHz wave has a free space wavelength of approximately 32 mm (1.26 in.) and a wavelength of approximately 15.7 mm (0.62 in.) through an epoxy/fiberglass laminate. Traditionally, an A-sandwich radome for X-band radar has facings which have a thickness of approximately 5% of the wavelength, which would be approximately 0.79 mm (0.031 in.). The thickness of the honeycomb core 12, which is electromagnetically similar to free space, is adjusted such that the entire sandwich construction, core and facings, is approximately a quarter wavelength thick for near incidence angles, or approximately 8 mm (0.31 in.). Therefore, if each of the facings are 0.79 mm (0.031 in.) thick, and the entire wall should be approximately 8 mm (0.31 in.) thick, the inner honeycomb core is approximately 6.4 mm (0.25 in.) thick in order for the entire sandwich to constitute a quarter wavelength wall.

As a result of proper material choice and material thickness, an A-sandwich approximately 8 mm (0.31 in.) thick can have an average transmission efficiency exceeding recommended minimums of 90%. The epoxy/fiberglass laminate facing material is selected to meet the structural requirements at the required thinwall thickness. The core thickness, and consequently the facing spacing, is then adjusted to further tune the entire radome wall to the frequency of the radar to be transmitted therethrough. Also, as the incidence angle of the beam to the wall increases substantially (e.g., 60°) the optimum core thickness must increase. However, a radome wall construction as defined above will not work well at 94 GHz, as it results in severe signal degradation at that frequency. Furthermore, a 94 GHz beam has a wavelength approximately 1/10th as long as that of the 9.345 GHz weather radar system. It is not possible to create a functional air transport A-sandwich radome wall for a 94 GHz radar wave using the traditional A-sandwich design approach because each of the layers would need to be 1/10 as thick as that for the X-band. The resulting radome wall would be structurally inadequate for aircraft nose radome applications.

Previously incorporated co-owned U.S. Pat. No. 5,408,244 to Mackenzie discloses a D-sandwich radome wall which could be designed to work satisfactorily at 94 GHz. It has unique properties in the millimeter wave region. As seen in FIG. 2, the D-sandwich 50 comprises a low dielectric material 52 bounded by intermediate layers 54, 56 of a high dielectric material which themselves are bounded by additional layers 58, 60 of a low dielectric constant material. The dielectric constant, loss tangent, and thickness of the various materials can be chosen to provide excellent transmission efficiency over the 94 GHz frequency range. However, the D-sandwich cannot be used for the dual band system of weather and millimeter wave radar, as the D-sandwich radome wall construction when tuned in the millimeter wave region does not have satisfactory transmission efficiency at 9.345 GHz.

SUMMARY OF THE INVENTION

It is therefore an object of the invention to provide a dual band radome wall which has satisfactory transmission efficiency for both X-band weather radar and W-band imaging radar.

It is another object of the invention to provide a radome wall which has sufficient structural integrity for air transport aircraft use.

It is a further object of the invention to provide a radome wall which is constructed of off-the-shelf materials.

It is also an object of the invention to provide a dual band, high efficiency radome wall for air transport nose radome applications which meets the structural and durability requirements for the flight environment.

In accord with these objects which will be discussed in detail below, a radome wall construction is provided which includes a sandwich of a foam core bounded by epoxy/quartz laminate facings. The facing thickness is approximately 0.79 mm (0.031 in.) thick so each facing acts as a half wavelength wall or a 94 GHz wave and a thinwall for a 9.345 GHz wave.

The dual band radome wall of the invention has atisfactory transmission efficiency at two discrete requencies. The radome wall will permit highly efficient radar ransmission at both the 9.345 GHz and 94 GHz frequencies making the radome wall suitable for use with aircraft outfitted with both weather and imaging radar. In addition, the radome wall of the invention is strong and durable and meets aircraft flight requirements.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
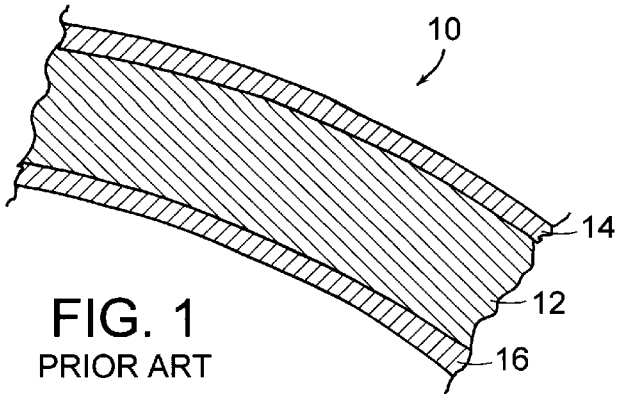
FIG. 1 PRIOR ART
FIG. 1 is a schematic section of a prior art A-sandwich radome wall construction.
Figure 2:
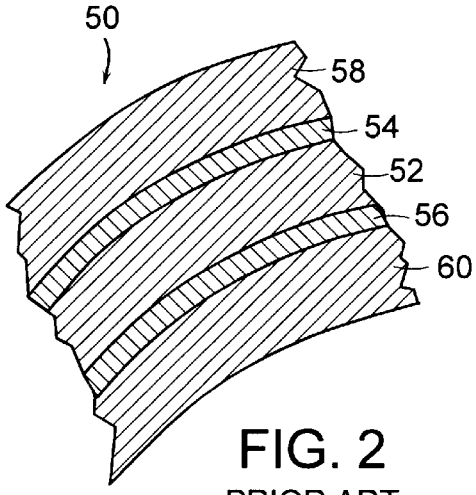
FIG. 2 PRIOR ART
FIG. 2 is a schematic section of a prior art D-sandwich radome wall construction.
Figure 3:
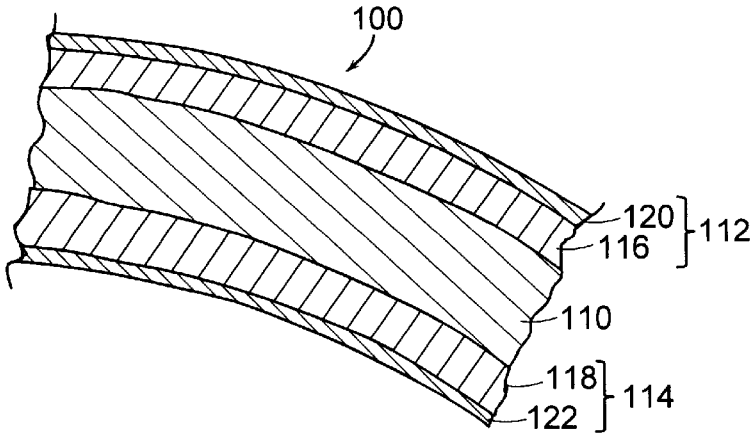
FIG. 3 is a schematic section of a radome wall construction according to the invention.

Referring now to FIG. 3, the radome wall 100 of the invention is illustrated. Generally, the radome wall has a foam core 110 bounded by an outer facing 112 and an inner facing 114. The outer facing 112 is typically comprised of an inner laminate 116 and a paint system layer 120. The inner facing 114 is preferably comprised of an inner laminate 118 and a thin ply of fiberglass 122. The inner and outer facings are sized such that each facing is a half wavelength wall for a 94 GHz wave and further that each facing is a thinwall for a 9.345 GHz wave. The various layers can be formed into a unitary structure having a desired radome shape, according to methods known in the art.

More particularly, the foam core 110 is preferably an impact resistant thermoplastic closed cell foam and preferably made from polymethacrylimide, polyvinylchloride-diisocyanate blend, or polyetherimide. Foams of this type have substantial internal uniformity. The foam core 110 is between 3.2 mm and 25.4 mm (1/8 in. to 1 in.) thick, with a preferable thickness of between 6.4 mm and 12.7 mm (between 1/4 and 1/2 in.), where the core thickness is tuned for optimum X-band performance consistent with the structural needs. The foam core should have a density in the range of 64 to 240 kg/m$^3$ (4 to 15 lb/ft$^3$), a compressive strength in the range of 12.7 to 42.2 kg/cm$^2$ (180–600 psi), a tensile strength in the range of 22.5 to 56.2 kg/cm$^2$ (320–800 psi), a shear strength in the range of 12.7 to 28.1 kg/cm$^2$ (180–400 psi), and a shear modulus in the range of 140 to 563 kg/cm$^2$ (2000–8000 psi). According to a presently preferred embodiment, the foam core has a density of approximately 110 kg/m$^3$ (7 lb/ft$^3$), a compressive strength of approximately 16.2 kg/cm$^2$ (230 psi), a tensile strength of approximately 26 kg/cm$^2$ (370 psi), a shear strength of approximately 16 kg/cm$^2$ (230 psi), and a shear modulus of approximately 316 kg/cm$^2$ (4500 psi), The laminate 116, 118 of the facings 112, 114 is preferably a 2-ply epoxy/aerospace industry style 4581 quartz fiber (e.g., Astroquartz™ III) laminate, approximately 0.66 mm (0.026 in.) thick. An epoxy/quartz laminate was selected because it can be manufactured to relatively tight tolerances and because quartz fiber provides a wall having a lower dielectric constant and loss tangent than fiberglass. In addition, the 2-ply epoxy-quartz laminate provides substantial durability, as confirmed by hail impact tests, and should provide long term durability rivalling the 3-ply fiberglass laminates used in conventional X-band radome design. The paint system layer 120 provided on the outer facing preferably has a thickness in the range of 0.13–0.20 mm (0.005–0.008 in.). The paint system layer 120 also provides protection from rain erosion and static electricity. To balance and compensate for the thickness of the paint system layer on the outer facing, an approximately 0.13 mm (0.005 in.) ply of "aerospace industry style 120 fiberglass" fabric 122 is provided on the inner facing to compensate for the electromagnetic effects of the paint system layer 120 on the outer facing. Alternatively, a similarly thin layer of quartz fiber (e.g., 14 micron yarn) may also be used instead of the "aerospace industry style 120 fiberglass" layer. The facings 112, 114 provide adequate structural strength and the necessary protection from environmental elements. Fiberglass and fiberquartz materials suitable for use herein may be obtained from JPS Glass Fabrics, Slater, S.C.

As calculated above, a half wavelength wall for a 94 GHz wave is 0.79 mm (0.031 in.), which is also approximately the thickness required for a wall to be a thinwall for a 9.345 GHz wave. The outer facing preferably has a thickness of 0.79 mm (0.66 mm laminate+0.13 mm paint system), although greater thicknesses have successfully been used, for example, a 0.66 mm (0.026 in.) laminate combined with a 0.20 mm (0.008 in.) paint system. The inner facing also has a preferable thickness of 0.79 mm (0.66 mm laminate+0.13 mm fiberglass ply). It will therefore be appreciated that the inner and outer facings are each a half wavelength wall for a 94 GHz wave and further that each facing is approximately a thinwall for a 9.345 GHz wave.

As a result, the facings have a dielectric thickness optimized for the frequencies for which the wall has been designed to transmit.

The foam core is a relatively low dielectric material highly transparent to the radar and, as a result, slight variation in foam core thickness which controls facing spacing has not been found to cause performance degradation at 94 GHz. In fact, for a 94 GHz wave no substantial difference has been found when varying the thickness of the foam core between 6.9 and 8.9 mm (0.27–0.35 in.) on an actual Boeing 727/737 radome. While a facing spacing of 8.9 mm is slightly thicker than previously used for X-band radome walls, the thicker spacing nevertheless allows satisfactory performance for a 9.345 GHz wave.

Figure 4:
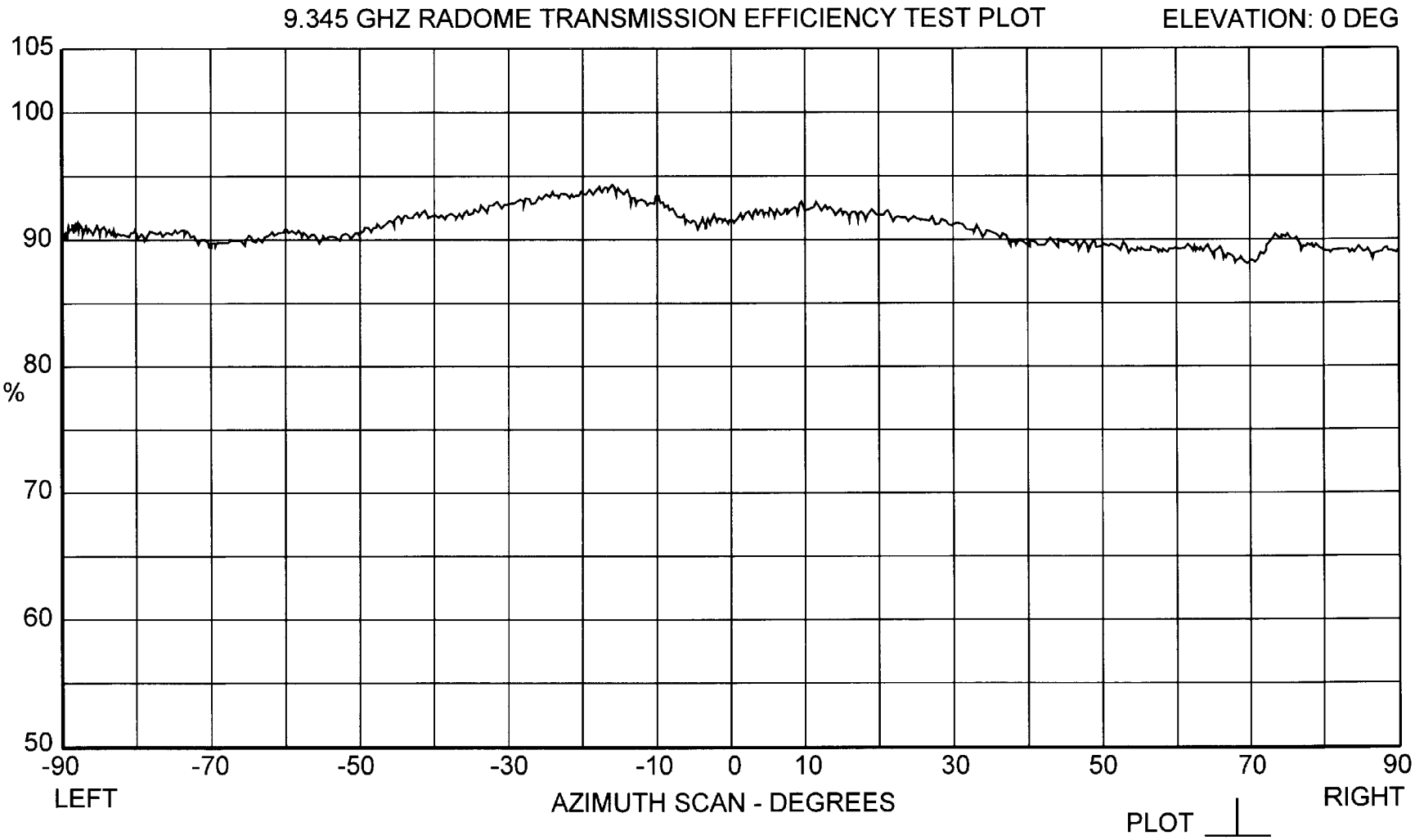
FIG. 4 is graph of the transmission efficiency for a 9.345 GHz wave through a radome constructed according to the invention.
Figure 5:
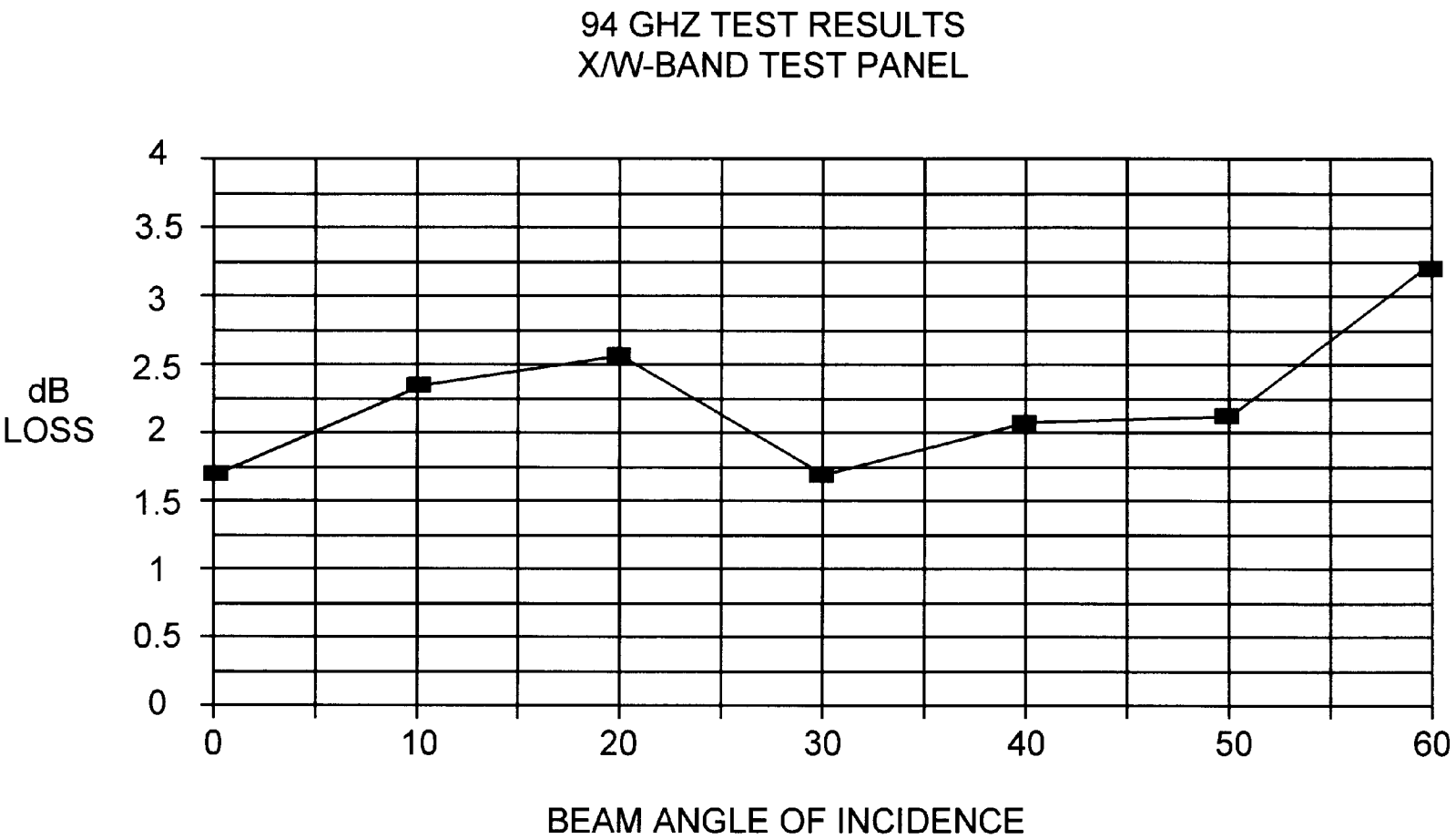
FIG. 5 is a graph of the transmission efficiency for a 94 GHz wave through a flat test panel radome constructed according to the invention.

The radome construction described above can be used for making blunt nose radomes, e.g., a Boeing 747 radome, and relatively more pointed radomes, e.g., a Boeing 727/737 radome, for both large and small air transport aircraft while maintaining satisfactory transmission efficiency for both the 9.345 GHz weather band and the 94 GHz millimeter wave radar. Referring to FIG. 4, transmission by an X-band weather radar antenna at 0° elevation through a Boeing 727/737 radome constructed according to the invention confirms that the radome is effective. The average transmission efficiency exceeds 90% over a±90° antenna scan angle, and the transmission efficiency does not drop below 88% for any angle between −90° and 90°. To accomodate the W-band radar antenna below the X-band radar antenna, the X-band antenna was located relatively high within the radome during the test, presenting relatively shallow incidence angles when looking forward through the upper surface contour of the radome. Nevertheless, transmission efficiency remained acceptable. Similar results are obtained with other antenna elevations. Peferring to FIG. 5, a 94 GHz wave is also successfully transmitted through a test panel simulating Boeing 727/737 and 747 radomes. The 727/737 shape is somewhat pointed from a top view and has the least friendly shape of all large air transport radomes. It has a beam to wall incidence angle of about 50° from normal when considering the beam from the left and right edges of a 61 cm (24 in.) wide W-band antenna. FIG. 5 shows that at a 50° beam to wall incidence angle, the radome construction has approximately a 2.2 dB loss. A 747 radome is more blunt and has, at worst, a beam to wall incidence angle of 30° for a 61 cm wide antenna. At a 30° beam to wall incidence angle the construction has approximately a 1.7 dB loss. Satisfactory transmission efficiency is therefore substantially duplicated through a 747 radome shape constructed according to the invention. A 0° to 60° scan across the test panel shows that transmission loss is approximately between 1.4 to 3.5 dB for all such beam to wall incidence angles. This demonstrates that a maximum loss of 3.5 dB, and under optimum conditions, a maximum loss of 2.4 dB for W-band radar can be achieved with the invention.

It will be further appreciated that fiberglass may be used instead of quartz fiber for the facing laminates. However, quartz fiber is preferable in comparison to fiberglass, as the epoxy/fiberquartz laminate has a lower dielectric constant (3.2 compared to 4.2), a lower loss tangent (~0.011 compared to ~0.016), a higher modulus of elasticity, and increased tensile and shear strength.

In addition, it will be appreciated that the dual band radome wall disclosed can be constructed of relatively easy to obtain commercial resins. The epoxy resin is relatively low cost and is available in the civil aircraft radome repair industry. Using commercial materials enables less expensive manufacture and permits damaged radomes to be easily repaired. Other lower electromagnetic loss resins are available which can be used with this invention. However, they are more costly and not typically available in radome repair facilities at the present time. Polyester and other low cost resins may also be used dependent on the application.

There has been described and illustrated herein a wall construction for a radome. While particular embodiments of the invention have been described, it is not intended that the invention be limited thereto, as it is intended that the invention be as broad in scope as the art will allow and that the specification be read likewise. Thus, while a variety of materials have been disclosod, it will be appreciated that other materials which have the desired dielectric properties and the structural strengths required may also be used. In addition, while preferable thicknesses for each of the materials have been disclosed it will be appreciated that a range of thicknesses may be used which offer satisfactory results according to the design principles disclosed herein. Furthermore, while the above description has particularly addressed radomes for air transport aircraft, it will be appreciated that the described radome construction may also be used, without limitation, on business jet and prop aircraft, helicopters, and ground and sea based installations. It will therefore be appreciated by those skilled in the art that modifications could be made to the provided invention without deviating from its spirit and scope as so claimed.

We claim:

1. A radome, comprising:

a) a core layer of dielectric material having substantial internal uniformity, having a first thickness and a first dielectric constant, said core layer having an inner surface and an outer surface, b) an outer facing applied to said outer surface and having a substantially uniform second thickness and a second dielectric constant relatively higher than said first dielectric constant, and c) an inner facing applied to said inner suiface and having a substantially uniform third thickness and a third dielectric constant, wherein said second and third thicknesses are chosen such that said outer facing and said inner facing are substantially half wavelength walls for radar waves of a first frequency and substantially thinwalls for radar waves of a second frequency, lower than the first frequency.

2. A radome according to claim 1, wherein:

each of said outer facing and said inner facing comprises a laminate, said third thickness being substantially the same as said second thickness, and said third dielectric constant being substantially the same as said second dielectric constant.

3. A radome according to claim 2, wherein:

said outer facing comprises an outer paint layer of a fourth thickness and said inner facing comprises an innermost layer having approximately the same electromagnetic thickness as said paint layer.

4. A radome according to claim 3, wherein:

said core layer is an impact grade thermoplastic closed cell foam having a thickness in the range of 3.2 and 25.4 mm.

5. A radome according to claim 4, wherein:

said foam is made from one of polymethacrylimide, polyvinylchloride-di-isocyanate blend, and polyetherimide.

6. A radome according to claim 1, wherein:

said core layer has a density in the range 64–240 kg/m$^3$, a compressive strength in the range of 12.7–42.2 kg/cm$^2$, a tensile strength in the range of 22.5–56.2 kg/cm$^2$, a shear strength in the range of 12.7–28.1 kg/cm$^2$, and a shear modulus in the range 140–563 kg/cm$^2$.

7. A radome according to claim 1, wherein:

said core layer has a density of approximately 110 kg/m$^3$.

8. A radome according to claim 7, wherein:

said core layer has a compressive strength of approximately 16.2 kg/cm$^2$, a tensile strength of approximately 26 kg/cm$^2$, a shear strength of approximately 16 kg/cm$^2$, and a shear modulus of approximately 316 kg/cm$^2$.

9. A radome according to claim 2, wherein: each said laminate are each a 2-ply epoxy/aerospace industry style 4581 quartz fiber system.

10. A radome according to claim 3, wherein:

said innermost layer comprises aerospace industry style 120 fiberglass.

11. A radome according to claim 3, wherein:

said first thickness is in the range of 6.3–8.9 mm, said second and third thicknesses are in the range of 0.66–0.89 mm, and said fourth thickness is in the range 0.13–0.020 min.

12. A radome, defining a radome wall comprising:

a) a core layer of between 3.17–25.4 mm thick, b) an outer facing layer of between 0.72–0.86 mm thick; and c) an inner facing layer of between 0.72–0.86 mm thick, wherein said radome wall has a transmission efficiency exceeding 80% for both X-band and W-band radar.

13. A radome according to claim 12, wherein:

said radome wall has a transmission efficiency exceeding 85% for X-band radar and has a maximum loss of 3.5 dB for W-band radar.

14. A radome according to claim 12, wherein:

said radome wall has a transmission efficiency exceeding 90% for X-band radar and has a maximum loss of 2.4 dB for W-band radar.

15. A radome according to claim 12, wherein:

said core layer is approximately 7.9 mm thick, said outer facing layer is approximately 0.86 mm thick, and said inner facing layer is approximately 0.79 mm thick.

16. A radome according to claim 12, wherein:

said core layer is approximately 6.9 mm thick, said outer facing layer is approximately 0.86 mm thick, and said inner facing layer is approximately 0.79 mm thick.

17. A radome, comprising:

a) a substantially uniform foam core layer;

b) an outer facing having a first thickness; and c) an inner facing having a thickness substantially the same electrical thickness as said first thickness, wherein said outer facing and said inner facing are each approximately a thin wall for a first frequency and a half wavelength wall for a second frequency which is approximately ten times the first frequency.

* * * * *